US006523694B2

(12) United States Patent
Lux, Jr. et al.

(10) Patent No.: US 6,523,694 B2
(45) Date of Patent: Feb. 25, 2003

(54) ARTICLE-EMBEDDED FOLDING CONTAINER AND METHOD FOR PRODUCING SAME

(75) Inventors: Gerard Paul Lux, Jr., Charlotte, NC (US); Melanie A. Moore, Charlotte, NC (US)

(73) Assignee: Cadmus, Charlotte, NC (US)

( * ) Notice: Subject to any disclaimer, the term of this patent is extended or adjusted under 35 U.S.C. 154(b) by 81 days.

(21) Appl. No.: 09/777,219

(22) Filed: Feb. 5, 2001

(65) Prior Publication Data

US 2002/0104778 A1 Aug. 8, 2002

(51) Int. Cl.[7] ..... B65D 25/54
(52) U.S. Cl. ..... 206/782; 206/783; 206/769
(58) Field of Search ..... 206/775, 776, 206/777, 782, 783, 735, 538, 539, 756, 764, 765, 769; 229/162, 120.28–120.35

(56) References Cited

U.S. PATENT DOCUMENTS 1,763,416 A * 6/1930 Brierley ..... 229/120.28
3,682,297 A * 8/1972 Austin et al. ..... 206/387.11
3,747,831 A * 7/1973 Hanson ..... 206/277
4,235,158 A * 11/1980 Johnson, Jr. ..... 229/120.38
4,826,016 A * 5/1989 Foster ..... 229/120.011
4,925,087 A * 5/1990 Ostrander ..... 206/459.5
5,402,889 A * 4/1995 Hermann et al. ..... 206/443
5,495,983 A * 3/1996 Lelek ..... 206/315.2
5,816,411 A * 10/1998 Smith ..... 206/218
5,944,183 A * 8/1999 Rowland et al. ..... 206/232
6,089,369 A * 7/2000 Markey ..... 206/349
6,112,893 A * 9/2000 Aubry et al. ..... 206/277
6,371,366 B1 * 4/2002 Edgerton et al. ..... 206/756

* cited by examiner

*Primary Examiner*—Shian Luong
(74) *Attorney, Agent, or Firm*—Summa & Allan, P.A.

(57) ABSTRACT

A packaging blank capable of forming a container having at least two internal compartments comprises in one embodiment a substantially rectangular bottom panel having opposing first and second side panels, a substantially rectangular top panel connected to the bottom panel by the second side panel, and an internal panel connected to the top panel by a first glue flap, wherein the bottom panel typically includes at least one display window. Upon construction the packaging blank provides a container having multiple internal compartments that may be viewable through a plurality of display windows. A method of packaging a product and an associated article comprises in one embodiment the steps of providing a blank, folding the internal panel over the top panel, positioning the article on the internal panel, folding the bottom panel over the internal panel, and securing the container formed by the blank.

23 Claims, 3 Drawing Sheets

ARTICLE-EMBEDDED FOLDING CONTAINER AND METHOD FOR PRODUCING SAME

FIELD OF THE INVENTION

The invention relates to a packaging blank. In particular, the invention relates to a packaging blank capable of forming a container having multiple internal compartments. The invention further relates to a container formed from the blank that includes multiple internal compartments and one or more display windows that provide a view of the internal compartments. Still further, the invention relates to a method of packaging articles in the container wherein the container is formed around the articles. The articles to be positioned can include a variety of components, including informational inserts, coupons, warranty cards, warning cards, pouches, sachets, or similar substantially flat articles.

BACKGROUND OF THE INVENTION

Conventional packaging includes top walls, bottom walls, side walls, and closure panels for containing various products. As known to those skilled in the art, packaging is typically formed from packaging blanks, or blanks for short. It will be understood that as used herein the term "blank" may include cardboard, rigid paper, flexible plastic, or similar products made of paperboard or plastic. In particular, the packaging industry favors the use of one-piece flexible blanks, which are readily incorporated into automated processes for forming packaging containers.

As used herein, the term "article" will refer primarily to an informational insert or insert for short. Typical inserts are large sheets of printed paper that are folded to a smaller size for inclusion into a packaging container. Generally, the inserts are inserted into the interior of the containers alongside the primary product.

Today, the packaging of inserts, in concert with an associated product, is managed in the product manufacturers' facilities. Actual insertion into the container is accomplished by either manual or automated processes. As an example, pharmaceutical manufacturers are often required to include one or more informational inserts along with their primary products (e.g., typically blister cards or plastic bottles of tablets). Manual insertion of inserts is slow and labor intensive. Although typically more efficient than manual insertion, automated insertion systems may result in increased waste, slower production speeds, and may also require additional labor on the line. By supplying an insert-embedded folding container, the need for manual or in-line insertion of inserts at the product manufacturer's site is eliminated, thus creating significant efficiencies in their production processes.

Product manufacturers in selected industries, such as the pharmaceutical industry, are required to incorporate Good Manufacturing Practices to ensure that the correct informational insert is married with the appropriate product being housed in the container. However, most containers lack windows that permit a view of the inserts and any identifying code (e.g., bar code) printed on the insert. Thus, once sealed, it is necessary to actually destroy the package in order to verify the process. Therefore, it is desirable to provide a packaging blank capable of forming a container that includes one or more display windows that permit viewing of one or more informational inserts contained therein. It will be understood that as used herein, the term "viewing" may include reading with the human eye or scanning with a bar code scanner.

Most current processes employed create packaging on one apparatus and then insert products and associated inserts on a separate apparatus after the container is formed. The method of packaging pharmaceuticals and inserts as described above typically uses a belt-driven conveyor for advancing a blank along a production line. In production, the blank is folded along fold lines and portions of the blank are secured to one another (e.g., by adhesive) to form a container. This process is typically completed by a packaging supplier who then ships the finished package to the product manufacturer. Subsequently, the product manufacturer mechanically inserts the primary product into the packaging. The insert can then either be manually or mechanically placed into the container.

Unfortunately, this method creates "dual inventories" at the product manufacturers' facilities. The product manufacturer is required to independently stock and track the primary product, the package, and the inserts up until the point of manufacture. Thus there is a need for a method for providing an insert-embedded folding container that simplifies the product manufacturer's inventory requirements.

OBJECT AND SUMMARY OF THE INVENTION

It is therefore an object of the present invention to provide for the packaging of a product and an associated insert suitable for use in automated processing.

Another object of the invention is the provision of a container formed from a blank that provides visual verification that the primary product is properly matched with its associated insert.

A further object of the invention is to increase the manufacturing efficiencies associated with placing informational inserts or other articles.

Yet another object of the invention is to improve inventory management by eliminating the necessity for manufacturers to track separate inventories for containers and inserts.

The invention meets these objectives with a packaging blank capable of forming a container having multiple internal compartments. In particular, the invention is a packaging blank having multiple display windows that provide a view of the internal compartments of the container upon construction. In another aspect, the invention is a method for packaging an article (e.g., insert) that incorporates the blank wherein the container is formed around the insert.

The foregoing and other objects and advantages of the invention and the manner in which the same are accomplished will become clearer based on the following detailed description taken in conjunction with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
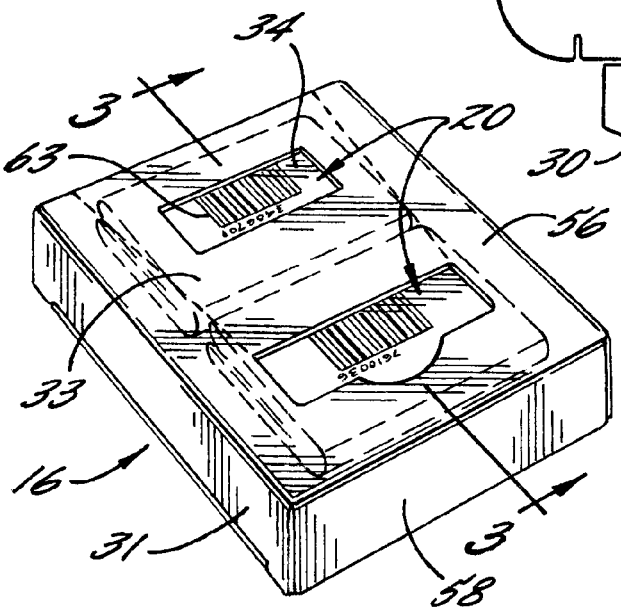
FIG. 1 is a perspective view of a preferred embodiment of the container illustrating the display windows that permit viewing of indicia printed on article (e.g., informational inserts) that are positioned in an internal compartment.

An overall view of a container 16 formed from a preferred embodiment of a packaging blank 10 which incorporates features of the present invention is set forth in FIG. 1. As used herein, the term "panel" is used in conjunction with the packaging blank of the present invention and refers to sections of the blank. Further, the term "wall" is used in conjunction with the container of the present invention and refers to structures forming the container.

Figure 2:
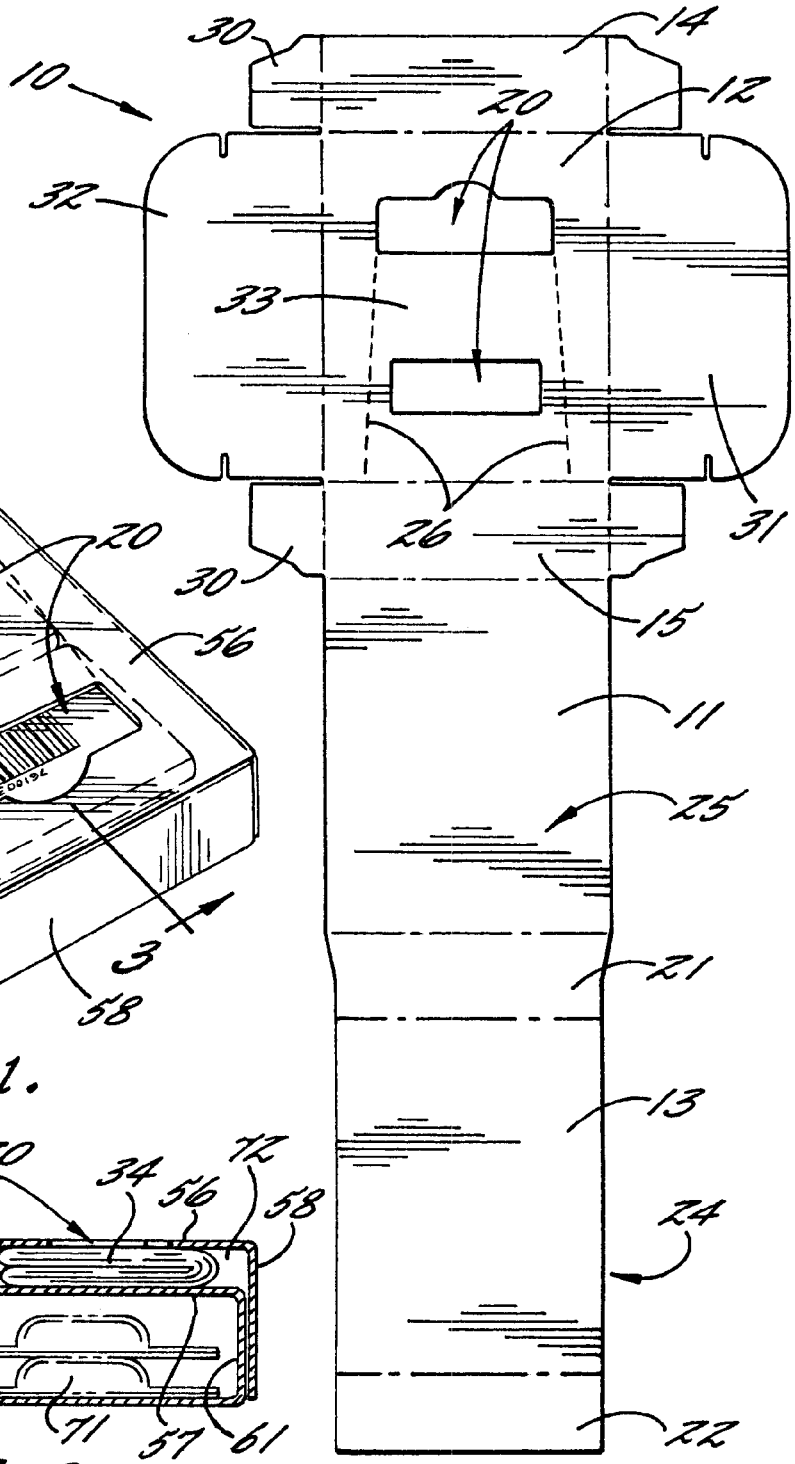
FIG. 2 is a top planar view of a preferred embodiment of the packaging blank depicting the top panel, bottom panel, internal panel, and display windows.

As depicted in FIG. 2, the packaging blank 10 includes a top panel 11, a bottom panel 12, and an internal panel 13. It will be understood by those of skill in the art that the terms top panel and bottom panel, and top wall and bottom wall, are also referred to as front panel and rear-panel in the packaging industry.

With reference to the orientation of the blank in FIG. 2, it will be understood that the term "width" refers to a distance measured from the lowermost portion of a side panel 14, 15 or glue flap 21, 22 to the uppermost portion of a side panel or glue flap. It will be further appreciated by those of ordinary skill in the art that, as used herein, the concept of a panel or wall being "between" two other panels or walls does not necessarily imply that the three panels or walls are contiguous (i.e., in intimate contact). Rather, as used herein, the concept of one panel or wall being between two other panels or walls is meant to describe the relative positions of the panels or walls within the blank or container structure, respectively. Similarly, as used herein, the concept of a first panel being connected to a second panel by a third panel, "opposite" the second panel, merely describes the relative positions of the first and second panels within the blank structure.

The bottom panel 12 of the preferred blank 10 as shown in FIG. 2 includes opposing first and second side panels 14, 15, and at least two display windows 20. An alternative embodiment of the preferred blank 10 may include a single window (not shown). The bottom panel 12 is connected to the top panel 11 by the second side panel 15. Upon constructing the blank 10 into a container 16, the window 20 facilitates bar code verification as discussed herein.

The internal panel 13 of the preferred embodiment is connected to the top panel 11 by a first glue flap 21. As depicted, the top panel 11 is positioned between the bottom panel 12 and the internal panel 13. The internal panel 13 includes a second glue flap 22 positioned opposite the first glue flap 21. The width of the second glue flap 22 is preferably less than the width of the first glue flap 21.

Advantageously, the blank 10 is capable of being folded such that the internal panel 13 divides the interior space defined by the top panel 11 and the bottom panel 12 in order to form more than one internal packaging compartment 23. See FIG. 3. Thus, the blank 10 is capable of forming a container 16 that has at least two internal compartments 23 for separately receiving a product 71 and an article 34 (e.g., insert).

In the preferred embodiment, the top panel 11, bottom panel 12, and internal panel 13 are substantially rectangular. Nevertheless, it will be understood that the top and bottom panels 11, 12 and internal panel 13 are not limited to a rectangular shape and may be oval, polygonal, or elliptical in shape.

As illustrated in the preferred embodiment of FIG. 2, the packaging blank 10 may be a one-piece flexible blank formed from paperboard or plastic. The blank 10 includes an external planar side 24 and an internal planar side 25. The external planar side 24 is preferably finished. As used herein, it will be understood that the term "finished" means coated with a material to produce an attractive glossy finish. The term "finished" will also be understood to mean the inclusion of printed material or other identifying indicia (e.g., a company's logo).

In order to facilitate the formation of a substantially rectangular container 16, the widths of the first and second side panels 14, 15 of the preferred embodiment are about equal to one another.

As depicted in FIG. 2, two pairs of dust flaps 30 are provided at opposing ends of the first side panel 14 and the second side panel 15. Each pair of dust flaps 30 extend beyond the ends of the first and second side panels 14, 15, and are foldable along fold lines formed in the blank 10. The dust flaps 30 form part of end closures for securing the container 16 as described herein. In the preferred embodiment, a pair of closure panels 31 is also provided at opposing ends of the bottom panel 12. Alternatively, the pair of closure panels 31 may be attached to opposing ends of the top panel 11. In yet another embodiment, a pair of closure panels 31 may be formed at opposing ends of both the bottom and top panel 12, 11 so that the opposing closure panels may be folded inwardly against one another in an overlapping fashion and adhered to one another. As known to those skilled in the art, this latter embodiment forms what is known as a "sealed end" carton or container.

The outermost opposing ends of each closure panel 31 may include an outermost tuck flap 32 for insertion into the interior of the container 16 upon construction. Accordingly, the dust flaps 30, closure panels 31, and tuck flaps 32 form the end closures for securing the container 16 formed from the blank 10.

As shown in FIG. 2, the preferred embodiment of the present invention provides a pull-flap 33 that is formed by perforations 26 in the bottom panel 12. The pull-flap 33 is positioned on the bottom panel 12 adjacent to one of the display windows 20 and defines at least one side of a first window. As configured, the pull-flap 33 of the preferred embodiment defines the entire perimeter of a second window.

Figure 4:
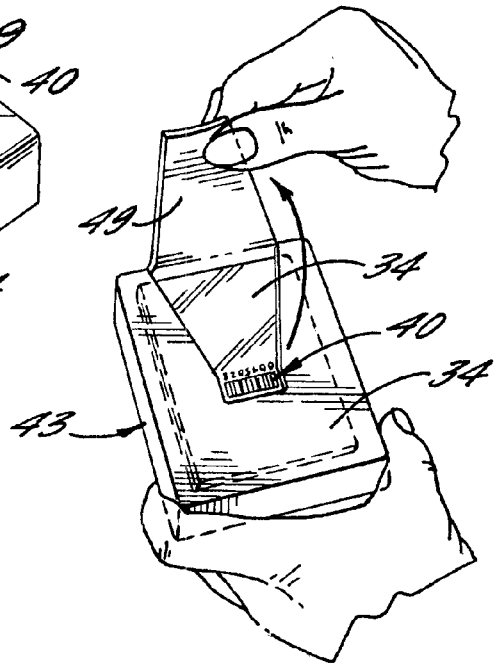
FIG. 4 is a perspective view of the container illustrating a user pulling the pull-flap upwardly, thereby detaching the sides of the pull flap from the bottom wall to gain access to the internal compartment containing the insert.
Figure 5:
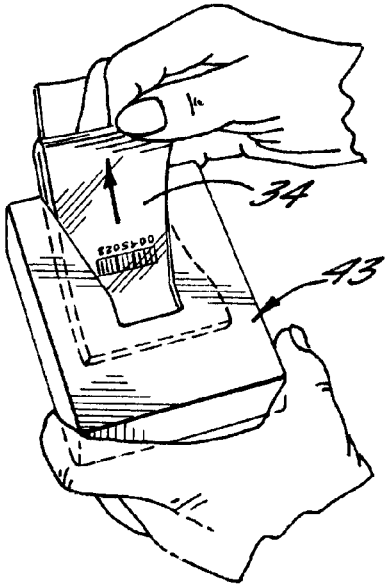
FIG. 5 is a perspective view of the container showing the user removing the insert from an internal compartment.
Figure 6:
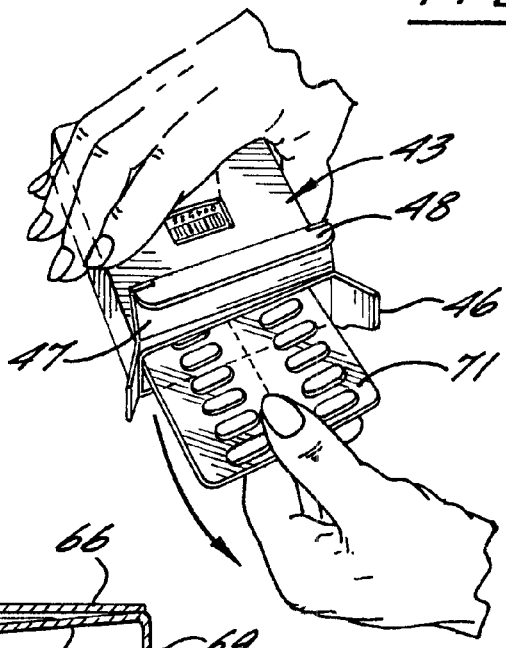
FIG. 6 is a perspective view of the container depicting the user removing a packaged product from an internal compartment.

In this configuration, the pull-flap 33 formed in the blank 10 provides a consumer with easy access to an insert 34 that may be placed in one of the internal compartments 23. Specifically, the pull-flap 33 permits the consumer to grasp the edge of the pull-flap adjacent a window, lift the flap away from the container 16 to tear the perforations 26 in the bottom panel 12, thereby separating the pull-flap from the bottom panel and providing access to the insert 34 contained within an adjacent internal compartment 23. See FIGS. 4, 5, and 6. Accordingly, the product 71 is preferably positioned in a first internal compartment 70 and the insert 34 is positioned in a second internal compartment 72. See FIG. 3.

As configured, the display windows 20 are positioned on the bottom panel 12 such that the external planar side 24 of the internal panel 13 is viewable through the display windows upon construction of the container 16. The display windows 20 thereby provide a view of at least two different positions on the external planar side 24 of the internal panel 13. Accordingly, two windows would provide a view of two separate inserts 34 and any indicia (e.g., bar code) printed thereon.

Figure 7:
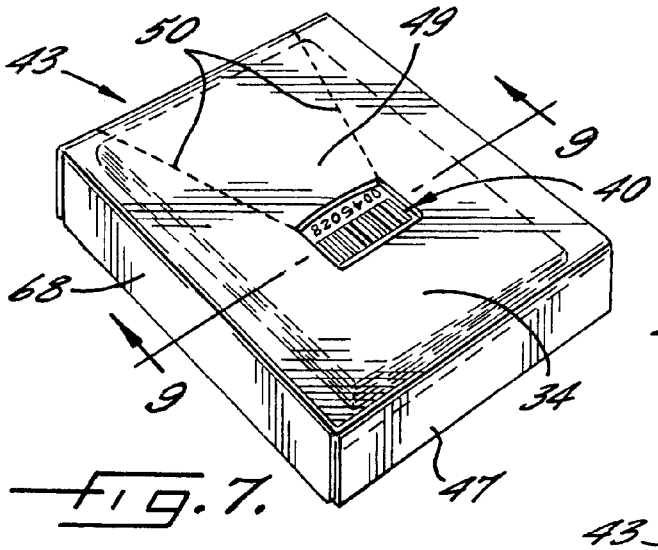
FIG. 7 is a perspective view of a second embodiment of the container illustrating a single display window.
Figure 8:
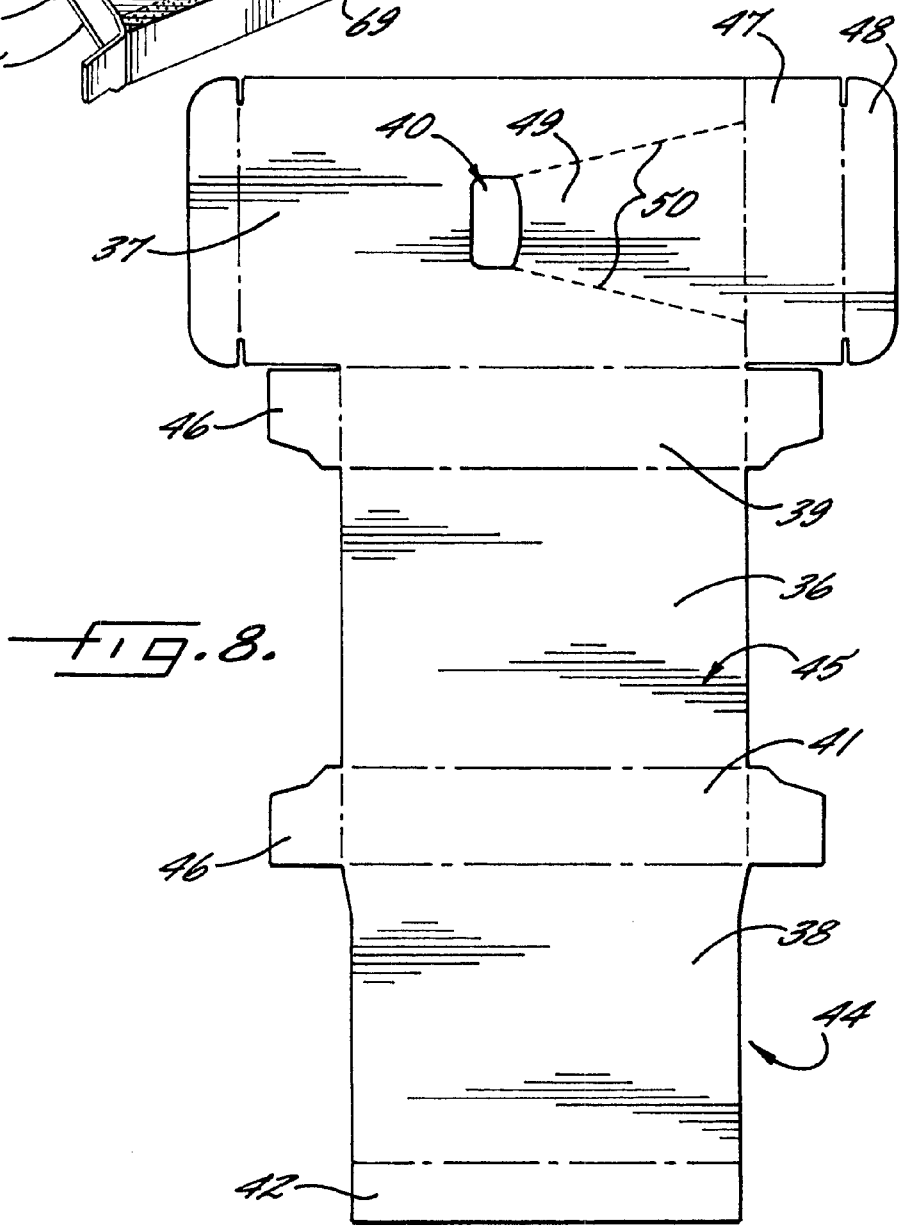
FIG. 8 is a top planar view of the second embodiment of the packaging blank.

A perspective view of a second embodiment of the present invention is depicted in FIG. 7. As illustrated in FIG. 8, the second embodiment of the invention includes a packaging blank 35 having a top panel 36, bottom panel 37, and an internal panel 38. The bottom panel 37 is connected to the top panel 36 by a first side panel 39, and includes at least one display window 40. The internal panel 38 of the second embodiment is connected to the top panel 36 by a second side panel 41. As depicted, the top panel 36 is positioned between the bottom panel 37 and the internal panel 38.

Figure 9:
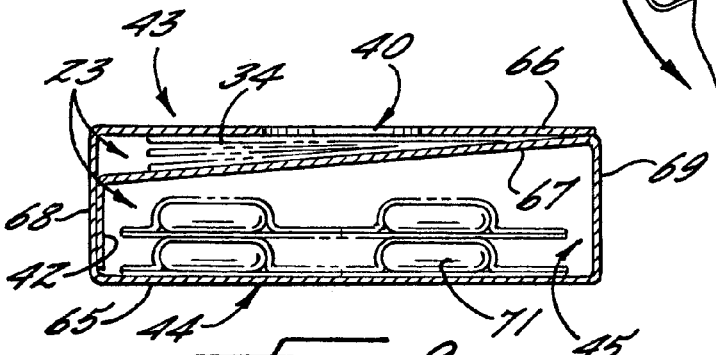
FIG. 9 is a cross-sectional view of the second embodiment of the container taken generally along lines 9—9 on FIG. 7 depicting a blister pack positioned in one internal compartment and an insert positioned in another internal compartment.
Figure 10:
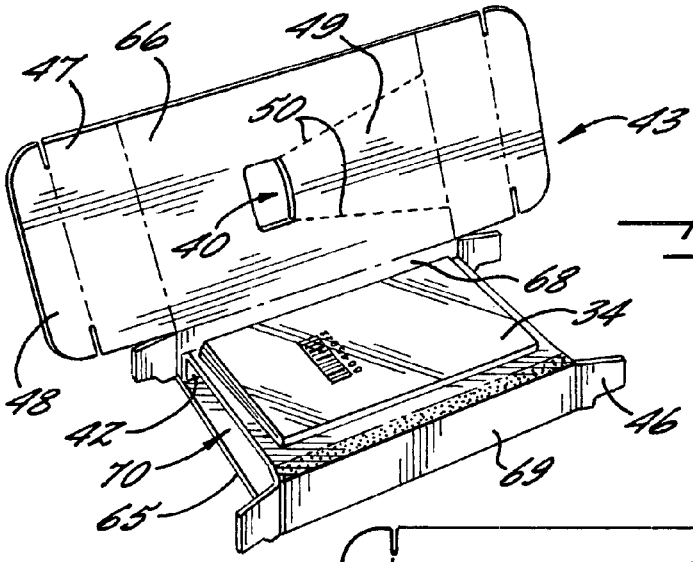
FIG. 10 is a perspective view of the packaging blank displaying an insert placed on the internal panel of the second embodiment.

The internal panel 38 includes a glue flap 42 positioned opposite the second side panel 41. The glue flap 42 has a width that is less than the width of the first side panel 39. As shown in FIG. 9, the second embodiment of the packaging blank 35 is likewise foldable such that the internal panel 38 (illustrated as an internal wall 67) divides the interior space of a container 43 defined by the top and bottom panels 36, 37 (illustrated as a top wall 65 and a bottom wall 66), thereby forming a multi-compartmented container.

With reference to FIG. 8, the second embodiment likewise consists essentially of a one-piece flexible paperboard blank 35 that includes a finished external planar side 44 and an internal planar side 45. In order for the second embodiment to facilitate the formation of the substantially rectangular container 43, the width of the first side panel 39 and the width of the second side panel 41 are about equal.

The end closures of the second embodiment depicted in FIG. 8 also include dust flaps 46, closure panels 47, and tuck flaps 48 similar to the first embodiment of FIG. 2. In other words, the first and second side panels 39, 41 each include a pair of dust flaps 46 formed at respective opposing ends. In addition, a pair of closure panels 47 and associated tuck flaps 48 is likewise provided at opposing ends of either the bottom panel 37 or top panel 36 to secure the container 43. In another embodiment, a pair of closure panels 47 may be formed at opposing ends of both the bottom and top panel 37, 36 so that the opposing panels may be folded against one another (i.e., overlapping) and adhered to form a sealed end carton.

The second embodiment also provides a pull-flap 49 formed by perforations 50 in the bottom panel 37. As illustrated in FIG. 8, the edge of the pull flap 49 is positioned adjacent the display window 40. As configured, at least one display window 40 is positioned on the bottom panel 37 such that the external planar side 44 of the internal panel 38 is viewable through the display window upon construction of the container 43.

The multiple windows of the preferred embodiment and the single window of the second embodiment are similar with respect to their positioning. Stated differently, each window 20, 40 of the first and second embodiments is positioned on the bottom panels 12, 37 such that a portion of the external planar sides 24, 44 of the internal panels 13, 38 is viewable through each window when the packaging blanks 10, 35 are formed into containers 16, 43.

Another aspect of the present invention, as illustrated in FIG. 1, includes a container 16 formed from the packaging blank 10 that has multiple internal compartments 23. As described above, the term "wall" is used in conjunction with the container of the present invention—as opposed to the previously described blank. Further, the term wall refers to structures forming the container as opposed to the sections of the blank. With reference to the orientation of the container in FIG. 1, it will be understood that the term "width" refers to a distance measured from the base of the container to the top of the container.

Figure 3:
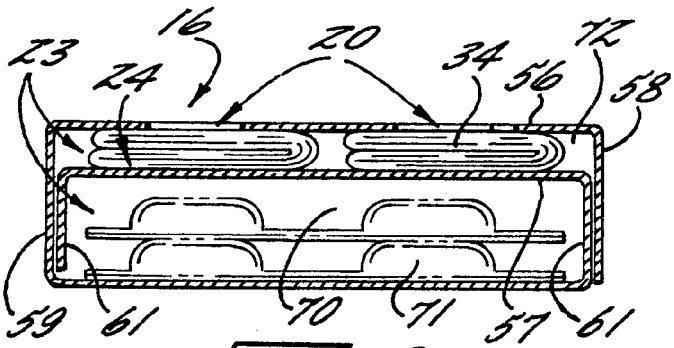
FIG. 3 is a cross-sectional view taken generally along lines 3—3 on FIG. 1 depicting a product (e.g., blister pack) positioned in one internal compartment and-articles (e.g., multiple inserts) positioned in another internal compartment of the preferred embodiment.

A preferred embodiment of the container includes a top wall 55, a bottom wall 56, and an internal wall 57. In the preferred embodiment the top wall 55, bottom wall 56, and internal wall 57 are substantially rectangular in shape, but may be oval, polygonal, or any similar shape supporting the construction of a container. The bottom wall 56 is connected to the top wall 55 by a first and second side wall 58, 59. At least one display window 20 is provided in the bottom wall 56 for viewing the internal wall 57 that is positioned between the top and bottom walls. See FIG. 3. Alternatively, it will be understood that a preferred embodiment of the container 16 may include a single window. The internal wall 57 is connected at each end to the first and second side walls 58, 59. The positioning of the internal wall 57 thereby defines multiple internal packaging compartments 23, that is to say, a first internal compartment 70 and a second internal compartment 72, within the container 16, as illustrated in FIG. 3.

The internal wall 57 of the preferred embodiment of the, container 16 includes a first glue flap 61 that connects the internal wall to the first side wall 58. The internal wall 57 also includes a second glue flap 62 attached to the second side wall 59. The width of the second glue flap 62 is preferably less than the width of the second side wall 59. The container 16 is preferably formed from a one-piece flexible paperboard blank 10 that includes an external planar side 18 and an internal planar side 25. The container 16 may also be formed from a one-piece flexible plastic blank. A preferred embodiment of the container 16 includes a finished external planar side that may include printed matter or similar indicia. In this configuration, the top wall 55, bottom wall 56, and internal wall 57 form substantially parallel planes. See FIG. 3.

The width of the first and second side walls 58, 59 are about equal to facilitate the formation of a substantially rectangular container 16. The first and second side walls 58, 59 each include a pair of dust flaps 30 formed at opposing ends of the respective side walls. In the preferred embodiment, the bottom wall 56 includes a pair of closure panels 31 formed at opposing ends of the bottom wall. It will be understood that the pair of closure panels 31 may, alternatively, be positioned at opposing ends of the top wall 55.

Each of the closure panels 31 may include a tuck flap 32 formed at opposing ends of the closure panels for insertion into the interior of the container 16. In an alternative embodiment lacking tuck flaps 32, an end closure may be formed from a pair of closure panels formed at opposing ends of both the bottom and top panel. In this configuration, the opposing panels may be folded inwardly against one another (i.e., overlapping) and adhered to one another, thus forming sealed end carton. It will be understood that an end of the container 16 may be secured in any number of ways consistent with standard packaging practices.

The preferred embodiment of the container 16 may also include a pull-flap 33 for providing access to the interior of the container. Specifically, perforations 26 in the bottom wall 56 define the pull-flap 33 that is positioned adjacent the display windows 20. As discussed, the pull-flap 33 provides easy access to multiple inserts 34 positioned on the internal wall 57 without destroying the sealed and secured package. As configured, at least one display window 20 is positioned on the bottom wall 56 such that a portion of internal wall 57 is viewable through display windows 20.

As shown in FIG. 3, the preferred embodiment includes any number of informational inserts 34 positioned on the internal wall 57. In this fashion, the inserts are viewable through the display windows 20.

An alternative embodiment of the container 43 also includes a top wall 65, a bottom wall 66, and an internal wall 67. See FIG. 9. The bottom wall 66 is likewise connected to the top wall 65 by a first and second side wall 68, 69. The bottom wall 66, however, includes a single display window 40. The internal wall 67 is similarly connected to the first and second side walls 68, 69. The internal wall 67 is also positioned between the top and bottom walls 65, 66, thereby forming more than one internal packaging compartment 23. The internal wall 67 also includes a single glue flap 42. In the second embodiment of the container 51, however, the glue flap 42 is attached to the first side wall 68. In this configuration, the top wall 65, bottom wall 66, and internal wall 67 form substantially parallel planes.

The second embodiment of the container 43 likewise may be formed from a one-piece flexible paperboard or plastic blank 35 that has an external planar side 44 and an internal planar side 45. Preferably, the external planar side is finished.

In regards to end closures, the first side wall 68 includes a pair of dust flaps 46 formed at opposing ends of the first side wall. The second side wall 69 likewise includes a pair of dust flaps 46 formed at opposing ends of the second side wall. The bottom wall 66 includes a pair of closure panels 47 formed at opposing ends of the bottom wall. Alternatively, the top wall 65 may include a pair of opposing closure panels 47. It will be understood that a pair of closure panels 47 may also be provided at opposing ends of both the top and bottom walls 65, 66 for forming a sealed end. Each closure panel 47 may also include a tuck flap 48 formed at the outermost opposing ends of the closure panels.

A pull-flap 49 is also provided in the second embodiment of the container 43. The pull-flap is similarly formed by perforations 50 in the bottom wall 66, and positioned adjacent to the display window 40. As described, the display window 40 is positioned on the bottom wall 66 such that a portion of the internal wall 67 is viewable through the display window.

Another aspect of the invention includes the use of the packaging blanks 10, 35 of the present invention in conjunction with a method-for packaging articles (e.g., informational inserts). This method is preferably accomplished at a packaging supplier's facility, thereby eliminating the requirement for a product manufacturer to package the product and its associated article (e.g., insert) in separate insertion steps. Stated differently, the product manufacturer is not required to independently stock and track the primary product, the associated inserts, and the package. As depicted, a flexible blank that includes an internal planar side and an external planar side is provided on a work station.

In a preferred method, a blank 10 is provided that includes a bottom panel 12 having first and second side panels 14, 15, and a top panel 11 connected to the bottom panel by the second side panel. The preferred method further provides a blank 10 having an internal panel 13 that is connected to the top panel 11 by a first glue flap 21 positioned opposite the top panel.

The internal panel 13 is then folded over the top panel 11 to form, upon construction, a first internal compartment 70 in which a product 71 to be packaged is positioned, for example, at a product manufacturer's facility during the final stages of packaging. See FIG. 3. Alternatively, a packaging manufacturer may incorporate the step of placing a product associated with the article on an internal planar side 25 of the flexible blank 10. It will be understood that the product may be placed on the top panel 11, the second side panel 15, or the internal panel 13 in this alternative method.

Upon folding the internal panel 13 over the top panel 11, the external planar side 24 of the blank 10 is presented for receiving at least one article 34 as described herein. In a preferred method, the internal panel 13 is folded along a fold line connecting the first glue flap 21 to the top panel 11 such that the internal panel is substantially parallel and adjacent to the top panel. In a preferred method, the blank provided includes a second glue flap 22 that is connected to the internal panel 13, and positioned opposite the first glue flap 21. As provided, the external planar side 24 of the second glue flap 22 is then adhered to the internal planar side 25 of the second side panel 15. In the preferred method, the internal panel 13 is folded over the top panel 11 such that the folded blank 10 is substantially flat.

After folding the internal panel 13 over the top panel 11 and adhering the second glue flap 22 to the second side panel 15, at least one article 34 is positioned on the external planar side 24 of the internal panel. It will be understood, that upon construction of the container, a second internal compartment 72 is formed in which the article is positioned. A preferred method of positioning the article 34 includes adhering the article to the external planar side 24 of the internal panel with adhesive or static charge.

The step of positioning an article may incorporate a conventional device that includes an arm having a suction means which retrieves an article and then positions the same on a panel of the blank. For example, an article 34 may be retrieved and then selectively placed on the blank 10 such that a bar code 63 on the article is viewable through a display window 20 upon construction of the container 16. Accordingly, a bar code scanner positioned along an automated production line may scan the bar code 63 on the article 34, thereby expediting pharmaceutical compliance. In other words, the product manufacturer can ensure that the appropriate article-embedded container is married with the appropriate product 71 (e.g., pharmaceutical) to be packaged in the container 16.

Subsequently, the bottom panel 12 is folded over the internal panel 13. In a preferred method, the bottom panel 12 is folded over the top panel 11 and the internal planar side of the first side panel 14 is adhered to the external planar side of the first glue flap 21, thereby forming a substantially flat container suitable for shipment and capable of being constructed into a substantially rectangular container 16.

Accordingly, the bottom panel 12 is folded over the internal panel 13 such that one or more articles 34 positioned on the internal panel are viewable though multiple display windows 20 formed in the bottom panel. The substantially flat container having an article 34 embedded therein, may subsequently be shipped to a product manufacturer where a product 71 can be married with its respective article-embedded container 16. Specifically, the substantially flat container can be constructed in a rectangular container 16 and the product 71 associated with the article 34 can be positioned in the first internal compartment 70.

Subsequently, the container may be secured by folding a pair of dust flaps 30 formed at opposing ends of the first and second side panels 14, 15 against the internal panel 13. A pair of tuck flaps 32 formed at the outermost opposing end of the bottom panel 12 is then inserted into the first internal compartment 70. Consequently, a pair of closure panels 31 formed at opposing ends of either the top panel 11 or the bottom panel 12 are positioned adjacent each pair of dust flaps 30 and the container 16 is secured. Nevertheless, it will be understood that an end closure may be formed from closure panels 31 formed at opposing ends of the top and bottom panels 11, 12 that do not include tuck flaps 32, such that an end of the container 16 may be secured by overlapping and adhering the closure panels to form a sealed end, thus securing the container.

Accordingly, the present method whereby an article is positioned on the blank, and the container is subsequently formed around the article, promotes substantially higher assembly speeds and lower waste than existing methods, whereby the container is formed and then the article is inserted into the finished container. Stated differently, the present method positions an article during the formation of the container, as opposed to inserting the article after construction of the container. Accordingly, upon construction of the container, the finished package includes an article and is ready to accept an associated product. Moreover, the present method is capable of incorporating a wide variety of products into the present container. For example, cosmetics, gifts, small toys, and the like may be packaged along with an associated insert in accordance with the present invention. In addition, multiple products can be placed in the same package. In cases where the container forming equipment allows faster construction speeds than the capability of one retrieval arm device, additional retrieval units can be placed along the production line and synchronized to deliver the finished product at a faster rate than previously achieved.

In the drawings and specification, there have been disclosed typical embodiments on the invention and, although specific terms have been employed, they have been used in a generic and descriptive sense only and not for purposes of limitation, the scope of the invention being set forth in the following claims.

That which is claimed is:

1. A container having at least two internal compartments, said container comprising:

a substantially rectangular top wall;

a substantially rectangular bottom wall that is connected to said top wall by a first side wall and a second side wall, said bottom wall including at least one display window;

an internal wall that is connected to said first and second side walls, wherein said internal wall is positioned between said top wall and said bottom wall, thereby forming more than one internal packaging compartment; and a pair of closure panels attached to opposing ends of either said top wall or said bottom wall;

wherein said internal wall includes a first glue flap attached to said first side wall.

2. A container according to claim 1, wherein said container consists essentially of a one-piece flexible blank.

3. A container according to claim 2, wherein said one-piece flexible blank has an external planar side and an internal planar side, said external planar side being finished.

4. A container according to claim 1, wherein said top wall, said bottom wall, and said internal wall form substantially parallel planes.

5. A container according to claim 1, wherein:

said internal wall includes a second glue flap that connects said internal wall to said second side wall; and wherein the width of said second glue flap and the width of said first glue flap are about equal.

6. A container according to claim 1, wherein said internal wall is substantially rectangular.

7. A container according to claim 1, wherein:

said first side wall includes a pair of dust flaps formed at opposing ends of said first side wall; and said second side wall includes a pair of dust flaps formed at opposing ends of said second side wall.

8. A container according to claim 1, further comprising a pull-flap formed by perforations in said bottom wall, said pull-flap positioned adjacent to said at least one display window.

9. A container according to claim 1, wherein said display window is positioned on said bottom wall such that at least a portion of said internal wall is viewable through said at least one display window.

10. A container according to claim 1, further comprising a plurality of articles positioned on said internal wall such that said articles are viewable through said at least one display window.

11. A container having at least two internal compartments, said container comprising:

a substantially rectangular top wall;

a substantially rectangular bottom wall that is connected to said top wall by a first and second side wall, said bottom wall including at least one display window;

a pair of closure panels formed at opposing ends of said bottom wall, each of said closure panels including a tuck flap formed at opposing ends of said closure panels;

a first pair of dust flaps formed at opposing ends of said first side wall;

a second pair of dust flaps formed at opposing ends of said second side wall;

an internal wall that is connected to said first and second side walls, said internal wall being positioned between said top wall and said bottom wall to thereby form more than one internal packaging compartment;

a first glue flap that connects said internal wall and said first side wall;

a second glue flap attached to said second side wall;

a pull-flap formed by perforations in said bottom wall, said pull-flap positioned adjacent to said at least one display window; and a plurality of articles positioned on said internal wall such that said articles are viewable through said at least one display window;

wherein said container consists essentially of a one-piece flexible blank.

12. A container according to claim 11, wherein said one-piece flexible blank has an external planar side and an internal planar side, said external planar side being finished.

13. A container having at least two internal compartments, said container comprising:

a substantially rectangular top wall;

a substantially rectangular bottom wall that is connected to said top wall by a first side wall and a second side wall, said bottom wall including at least one display window;

an internal wall that is connected to said first and second side walls, wherein said internal wall is positioned between said top wall and said bottom wall, thereby forming more than one internal packaging compartment; and a pair of closure panels attached to opposing ends of either said top wall or said bottom wall;

wherein said closure panels include a tuck flap formed at opposing ends of said closure panels;

wherein said internal wall includes a first glue flap attached to said first side wall.

14. A container according to claim 13, wherein said container consists essentially of a one-piece flexible blank.

15. A container according to claim 14, wherein said one-piece flexible blank has an external planar side and an internal planar side, said external planar side being finished.

16. A container according to claim 13, wherein said top wall, said bottom wall, and said internal wall form substantially parallel planes.

17. A container according to claim 13, wherein:

said internal wall includes a second glue flap that connects said internal wall to said second side wall; and wherein the width of said second glue flap and the width of said first glue flap are about equal.

18. A container according to claim 13, wherein said internal wall is substantially rectangular.

19. A container according to claim 13, wherein:

said first side wall includes a pair of dust flaps formed at opposing ends of said first side wall; and said second side wall includes a pair of dust flaps formed at opposing ends of said second side wall.

20. A container according to claim 13, further comprising a pull-flap formed by perforations in said bottom wall, said pull-flap positioned adjacent to said at least one display window.

21. A container according to claim 13, wherein said at least one display window is positioned on said bottom wall such that at least a portion of said internal wall is viewable through said at least one display window.

22. A container according to claim 13, further comprising a plurality of articles positioned on said internal wall such that said articles are viewable through said at least one display window.

23. A container having at least two internal compartments, said container comprising:

a substantially rectangular top wall;

a substantially rectangular bottom wall that is connected to said top wall by a first and second side wall, said bottom wall including at least one display window;

a pair of closure panels formed at opposing ends of said bottom wall, each of said closure panels including a tuck flap formed at opposing ends of said closure panels;

a first pair of dust flaps formed at opposing ends of said first side wall;

a second pair of dust flaps formed at opposing ends of said second side wall;

an internal wall that is connected to said first and second side walls, said internal wall being positioned between said top wall and said bottom wall to thereby form more than one internal packaging compartment;

a first glue flap that connects said internal wall and said first side wall;

a second glue flap attached to said second side wall;

a pull-flap formed by perforations in said bottom wall, said pull-flap positioned adjacent to said at least one display window; and a plurality of articles positioned on said internal wall such that said articles are viewable through said at least one display window;

wherein said container consists essentially of a one-piece flexible blank;

wherein said one-piece flexible blank has an external planar side and an internal planar side, said external planar side being finished.

* * * * *